US009915183B2

(12) United States Patent
Sealy et al.

(10) Patent No.: US 9,915,183 B2
(45) Date of Patent: Mar. 13, 2018

(54) FLUID CONTROL MODULE FOR WASTE HEAT RECOVERY SYSTEMS

(71) Applicant: Norgren Limited, Staffordshire (GB)

(72) Inventors: Mark Edward Byers Sealy, Warwickshire (GB); John Michael Morris, Auburn, WA (US); Christopher Edward Narborough, Derbyshire (GB); Patrick Williams, Birmingham (GB)

(73) Assignee: Norgren Limited, Lichfield (GB)

( * ) Notice: Subject to any disclaimer, the term of this patent is extended or adjusted under 35 U.S.C. 154(b) by 182 days.

(21) Appl. No.: 14/435,238

(22) PCT Filed: Oct. 17, 2013

(86) PCT No.: PCT/GB2013/052715

§ 371 (c)(1),
(2) Date: Apr. 13, 2015

(87) PCT Pub. No.: WO2014/060762

PCT Pub. Date: Apr. 24, 2014

(65) Prior Publication Data

US 2015/0285123 A1 Oct. 8, 2015

Related U.S. Application Data

(60) Provisional application No. 61/714,964, filed on Oct. 17, 2012, provisional application No. 61/823,102, (Continued)

(51) Int. Cl.
*F25D 9/00* (2006.01)
*F01N 5/02* (2006.01)
(Continued)

(52) U.S. Cl.
CPC ..... *F01N 5/02* (2013.01); *F01K 23/065* (2013.01); *F01K 23/101* (2013.01); *Y10T 29/49826* (2015.01); *Y10T 137/85978* (2015.04)

(58) Field of Classification Search
CPC ..... F25B 9/004; F25B 25/005; F25D 3/12
(Continued)

(56) References Cited

U.S. PATENT DOCUMENTS

2011/0209474 A1* 9/2011 Leibowitz ..... F01K 23/04 60/641.1
2012/0324891 A1* 12/2012 Raab ..... F01K 3/10 60/668
2013/0192229 A1 8/2013 Bruckner et al.

FOREIGN PATENT DOCUMENTS

AT 507408 A4 5/2010
DE 102010033124 A1 2/2012
(Continued)

*Primary Examiner* — Melvin Jones
(74) *Attorney, Agent, or Firm* — The Ollila Law Group LLC

(57) ABSTRACT

A waste heat recovery system (100) for an engine (101), comprises a fluid supply (104); two or more evaporators (120, 121) adapted to receive waste heat from an engine (101); a valve module (114) including an inlet port (115) in fluid communication with the fluid supply (104), a first outlet port (116) in fluid communication with a first evaporator (120) of the two or more evaporators (120, 121), and a second outlet port (117) in fluid communication with a second evaporator (121) of the two or more evaporators (120, 21), the module being adapted to selectively provide a fluid communication path between the fluid supply (104) and one or more of the two or more evaporators (120, 21). A fluid control module (200, 400) for a waste heat recovery system (100) with a 10 working fluid is provided. The static seal fluid control module (200, 400) includes a module body
(Continued)

(250, 430) at least partially enclosing a pump (220) and at least one valve (210, 230, 240, 410, 420) wherein no atmospheric dynamic seals retain the working fluid in the static seal fluid control module (200, 400).

28 Claims, 12 Drawing Sheets

Related U.S. Application Data filed on May 14, 2013, provisional application No. 61/828,260, filed on May 29, 2013, provisional application No. 61/844,973, filed on Jul. 11, 2013, provisional application No. 61/846,490, filed on Jul. 15, 2013.

(51) Int. Cl.
*F01K 23/06* (2006.01)
*F01K 23/10* (2006.01)

(58) Field of Classification Search
USPC ..... 62/401, 118, 196.1; 165/51
See application file for complete search history.

(56) References Cited

FOREIGN PATENT DOCUMENTS

| | | | |
|---|---|---|---|
| DE | 102010042458 | A1 | 4/2012 |
| EP | 0333357 | A1 | 9/1989 |
| JP | 04-107365 | A | 4/1992 |
| JP | 06-051649 | U | 7/1994 |
| JP | 2012-036989 | A | 2/2012 |

* cited by examiner

FLUID CONTROL MODULE FOR WASTE HEAT RECOVERY SYSTEMS

CROSS-REFERENCE TO RELATED APPLICATIONS

This is a National Stage entry of International Application No. PCT/GB13/52715, with an international filing date of Oct. 17, 2013 entitled "FLUID CONTROL MODULE FOR WASTE HEAT RECOVERY SYSTEMS", which claims priority of U.S. provisional patent application no. 61/714,964, filed Oct. 17, 2012 entitled "VEHICLE WASTE HEAT RECOVERY SYSTEM", U.S. provisional patent application no. 61/823,102 filed on May 14, 2013 entitled "BYPASS VALVE", U.S. provisional patent application no. 61/828,260 filed on, May 29, 2013 entitled "VEHICLE WASTE HEAT RECOVERY SYSTEM", U.S. provisional patent application no. 61/844,973 filed on Jul. 11, 2013 entitled "STATIC SEAL FLUID CONTROL MODULE FOR WASTE HEAT RECOVERY SYSTEMS" and U.S. provisional patent application no. 61/846,490 filed on Jul. 15, 2013 entitled "FLOW SPLITTER".

TECHNICAL FIELD

The embodiments described below relate to, fluid control modules, and more particularly, to fluid control modules for waste heat recovery systems.

BACKGROUND OF THE INVENTION

Internal combustion (IC) engines are used throughout the world and mainly for motor vehicles. IC engines account for one of the largest consumers of petroleum products known. Due to the large amount of petroleum products consumed by IC engines and the gases exhausted from IC engines, numerous regulatory agencies have implemented regulations or are in the process of implementing regulations that require minimum average fuel economy of vehicles as well as limit the amount of pollutants that are exhausted from vehicles.

Earlier attempts at reducing vehicle emissions have centered on exhaust gas treatments. For example, earlier attempts have introduced reagents into the exhaust gas stream prior to the gas passing through a catalyst in order to effect selective catalytic reduction (SCR) of the nitrogen oxides ($NO_x$) in the exhaust gases. Additionally, many vehicles now include exhaust gas recirculation (EGR) systems to recirculate at least some of the exhaust gases. Although EGR reduces the harmful emissions of vehicles, it also often reduces the vehicle's fuel economy.

The uses of SCR and EGR have been effective in reducing the emission problems in the exhaust stream, but have done little in improving the fuel economy and fuel consumption of vehicles. With the tighter regulations that are being implemented, many manufacturers have turned their focus to increasing the fuel economy of IC engines. It is generally known that only about thirty to forty percent of the energy produced by the fuel combustion of IC engines translates to mechanical power. Much of the remaining energy is lost in the form of heat. Therefore, one particular area of focus in the motor vehicle industry has been to recover some of the heat that is generated by the IC engine using a waste heat recovery system that converts heat into mechanical energy with, for example, a Rankine cycle.

While these prior art attempts have improved the vehicle's efficiency, they lack adequate control of the working fluid and the working fluid's temperature. For example, U.S. Pat. No. 4,031,705 discloses a heat recovery system that heats the working fluid using heat from the IC engine's exhaust and the IC engine's cooling circuit, i.e., the IC engine's radiator. Therefore, while the '705 patent does utilize multiple heat sources, there is no way to adequately control where the heat is being drawn from. This can be problematic at times since insufficient flow of working fluid to a heat source can reduce the overall efficiency of the heat recovery system and/or result in wet steam being fed to the expander.

Waste heat recovery systems may use a working fluid to recover the waste heat from the engine. Some waste heat recovery system may use water. In such waste heat recovery systems, the water may be heated to steam using an evaporator. Other fluids, which may be non-aqueous, and which may include hydrocarbons such as ethanol or organofluorines such as Freon®, may also be used due to properties such as heat transfer, vapor pressure or freezing point (for example, a freezing point temperature lower than that of water). However such other fluids may combust when exposed to a hot metal surface such as an exhaust pipe on an engine or may be restricted by regulations when released to atmosphere. The fluids may also decompose when exposed to atmosphere. Such fluids may also be more prone to leaking past dynamic seals, i.e. seals that employ abutting surfaces that are configured to move relative to one another, due to, for example, lower fluid viscosity or limited lubrication for the dynamic seals.

Many waste heat recovery systems employ fluid control modules to control the flow of the working fluid through the waste heat recovery systems. For example, the fluid control modules may employ valves that regulate the working fluid flow to expanders in the waste heat recovery system. Such valves may utilize dynamic seals with working fluid on one side of the dynamic seal and atmosphere on the other side of the dynamic seal. These may be referred to as atmospheric dynamic seals. Sometimes the dynamic seals fail unexpectedly causing the working fluid to leak to atmosphere or onto a hot engine surface. Static seals may not be as prone to failure as dynamic seals.

Accordingly, there is a need for a static seal fluid control module for waste heat recovery systems. There is also a need for waste heat recovery systems with fluid and vapor control modules that do not have atmospheric dynamic seals.

SUMMARY OF THE INVENTION

A static seal fluid control module for a waste heat recovery system with a working fluid is provided according to an embodiment. The static seal fluid control module comprises a module body at least partially enclosing a pump and at least one valve, the module body having no dynamic seals to atmosphere. In other words, all seals to atmosphere of the module body are static, with no relative movement of abutting sealing surfaces.

A method of forming a static seal fluid control module for a waste heat recovery system with a working fluid is provided according to an embodiment. The method of forming the static seal fluid control module further comprises forming and at least partially enclosing a pump and at least one valve with a module body without forming atmospheric dynamic seals that retain the working fluid in the static seal fluid control module.

A method of operating a static seal fluid control module is provided according to an embodiment. The method of operating the static seal fluid control module comprises receiving a working fluid at an inlet of the static seal fluid control module. The method of operating the static seal fluid control module further comprises providing the working fluid to one or more evaporators and to a pilot valve actuator on a bypass valve without containing the working fluid with an atmospheric dynamic seal.

A waste heat recovery system is provided according to an embodiment. According to an embodiment, the waste heat recovery system comprises at least one evaporator and an expander in selective fluid communication with the at least one evaporator via a bypass valve. The waste heat recovery system further comprises a static seal fluid control module in fluid communication with the at least one evaporator and a bypass valve wherein the fluid control module and the bypass valve have no atmospheric dynamic seals.

Aspects

According to an aspect, a static seal fluid control module for a waste heat recovery system with a working fluid, comprising:

a module body at least partially enclosing a pump and at least one valve wherein no atmospheric dynamic seals retain the working fluid in the static seal fluid control module.

Preferably, the pump and the at least one valve are substantially immersed in the working fluid.

Preferably, the pump comprises a rotor that is immersed in the working fluid.

Preferably, the pump comprises one or more bearings immersed in the working fluid.

Preferably, the pump comprises a stator at least partially enclosed by the module body.

Preferably, the at least one valve includes a core immersed in the working fluid.

Preferably, the at least one valve further comprises a return spring adapted to place the at least one valve in a zero position state when the at least one valve loses power.

Preferably, the return spring is immersed in the working fluid.

Preferably, the at least one valve comprises a valve that includes a solenoid at least partially enclosed by the module body.

Preferably, the at least one valve comprises a proportional flow control valve.

Preferably, the at least one valve comprises a proportional flow control valve that includes a proportional stem that is adapted to proportionally regulate a flow of the working fluid between a first evaporator port and a second evaporator port.

Preferably, the proportional flow control valve further comprises a return spring assembly adapted to return the proportional flow control valve to a zero position state.

Preferably, the at least one valve comprises a valve that includes a stem adapted to regulate the working fluid flow to a pilot valve actuator on a bypass valve.

Preferably, the at least one valve comprises a valve that includes a stem adapted to regulate a flow of the working fluid to a bypass circuit to de-superheat the working fluid.

Preferably, the at least one valve comprises a valve that includes a stem adapted to regulate the working fluid flow to a pilot valve actuator on a bypass valve and to a bypass circuit to de-superheat the working fluid.

Preferably, the static seal fluid control module further comprises a power line that is coupled to the pump or the at least one valve wherein the power line is at least partially enclosed by the module body.

Preferably, the static seal fluid control module further comprises a pump return that returns fluid from the at least one valve to the pump.

According to an aspect, a method of forming a static seal fluid control module for a waste heat recovery system with a working fluid comprises:

forming and at least partially enclosing a pump and at least one valve with a module body without forming atmospheric dynamic seals that retain the working fluid in the static seal fluid control module.

Preferably, the method of forming a static seal fluid control module further comprises substantially immersing the pump and the at least one valve in the working fluid.

Preferably, the method of forming and at least partially enclosing the pump comprises forming and immersing a rotor in the working fluid.

Preferably, the method of forming and at least partially enclosing the pump comprises forming and immersing one or more bearings in the working fluid.

Preferably, the method of forming and at least partially enclosing the pump comprises forming and at least partially enclosing a stator in the module body.

Preferably, the method of forming and at least partially enclosing the at least one valve includes forming and immersing a core in the working fluid.

Preferably, the method of forming the at least one valve further comprises forming and adapting a return spring to place the at least one valve in a zero position state when the at least one valve loses power.

Preferably, the method of forming and adapting the return spring further comprises immersing the return spring in the working fluid.

Preferably, the at least partially enclosing the at least one valve comprises at least partially enclosing a solenoid with the module body.

Preferably, the method of forming the at least one valve comprises forming a proportional flow control valve.

Preferably, the method of forming the proportional flow control valve comprises forming and adapting a proportional stem to proportionally regulate a working fluid flow between a first evaporator port and a second evaporator port.

Preferably, the method of forming the proportional flow control valve further comprises forming and adapting a return spring assembly to return the proportional control valve to a zero position state.

Preferably, the method of forming at least one valve comprises forming a valve that includes a stem adapted to regulate the working fluid flow to a pilot valve actuator on a bypass valve.

Preferably, the method of forming the at least one valve comprises forming and adapting a control valve that includes a stem to regulate the working fluid flow to a bypass circuit to de-superheat the working fluid.

Preferably, the method of forming at least one valve comprises forming and adapting a valve that includes a stem to regulate the working fluid flow to a pilot valve actuator on a valve and to a vapor control module to de-superheat the working fluid.

Preferably, the method of forming the static seal fluid control module further comprises forming and coupling a power line to the pump or the at least one valve and at least partially enclosing the power line with the module body.

Preferably, the method of forming the static seal fluid control module further comprises forming a pump return that returns fluid from the one or more valves to the pump.

According to another aspect, operating a static seal fluid control module comprises:

receiving a working fluid at an inlet of the static seal fluid control module; and providing the working fluid to one or more evaporators and to a pilot valve actuator on a bypass valve without containing the working fluid with an atmospheric dynamic seal.

Preferably, the operating the static seal fluid control module further comprises providing the working fluid to a bypass circuit without containing the working fluid with an atmospheric dynamic seal.

Preferably, the providing the working fluid to the bypass circuit further comprises providing the working fluid to a venturi that forms a portion of the bypass circuit.

According to an aspect, a waste heat recovery system comprises:

at least one evaporator;

an expander in selective fluid communication with the at least one evaporator via a bypass valve; and a static seal fluid control module in fluid communication with the at least one evaporator and a bypass valve wherein the fluid control module and the bypass valve have no atmospheric dynamic seals.

Preferably, the bypass valve is actuated by the working fluid.

Preferably, the bypass valve comprises a membrane bypass valve that includes an actuator seal that separates the working fluid from the actuator portion of the valve housing.

Preferably, the actuator seal further comprises a bellows coupled to a stem.

In each of the foregoing aspects, the engine may be an internal combustion engine.

Preferably, the internal combustion engine is a reciprocating piston engine.

Preferably, the internal combustion engine is configured to be mounted on, and to drive, a vehicle.

Preferably, the internal combustion engine is configured to operate according to a highway cycle.

DETAILED DESCRIPTION OF THE INVENTION

The above figures and the following description depict specific examples to teach those skilled in the art how to make and use the best mode of embodiments of a static seal fluid control module in a waste heat recovery system and a waste heat recovery system. For the purpose of teaching inventive principles, some conventional aspects have been simplified or omitted. Those skilled in the art will appreciate variations from these examples that fall within the scope of the present description. Those skilled in the art will appreciate that the features described below can be combined in various ways to form multiple variations of the static seal fluid control module and the waste heat recovery system. As a result, the embodiments described below are not limited to the specific examples described below, but only by the claims and their equivalents.

Figure 1:
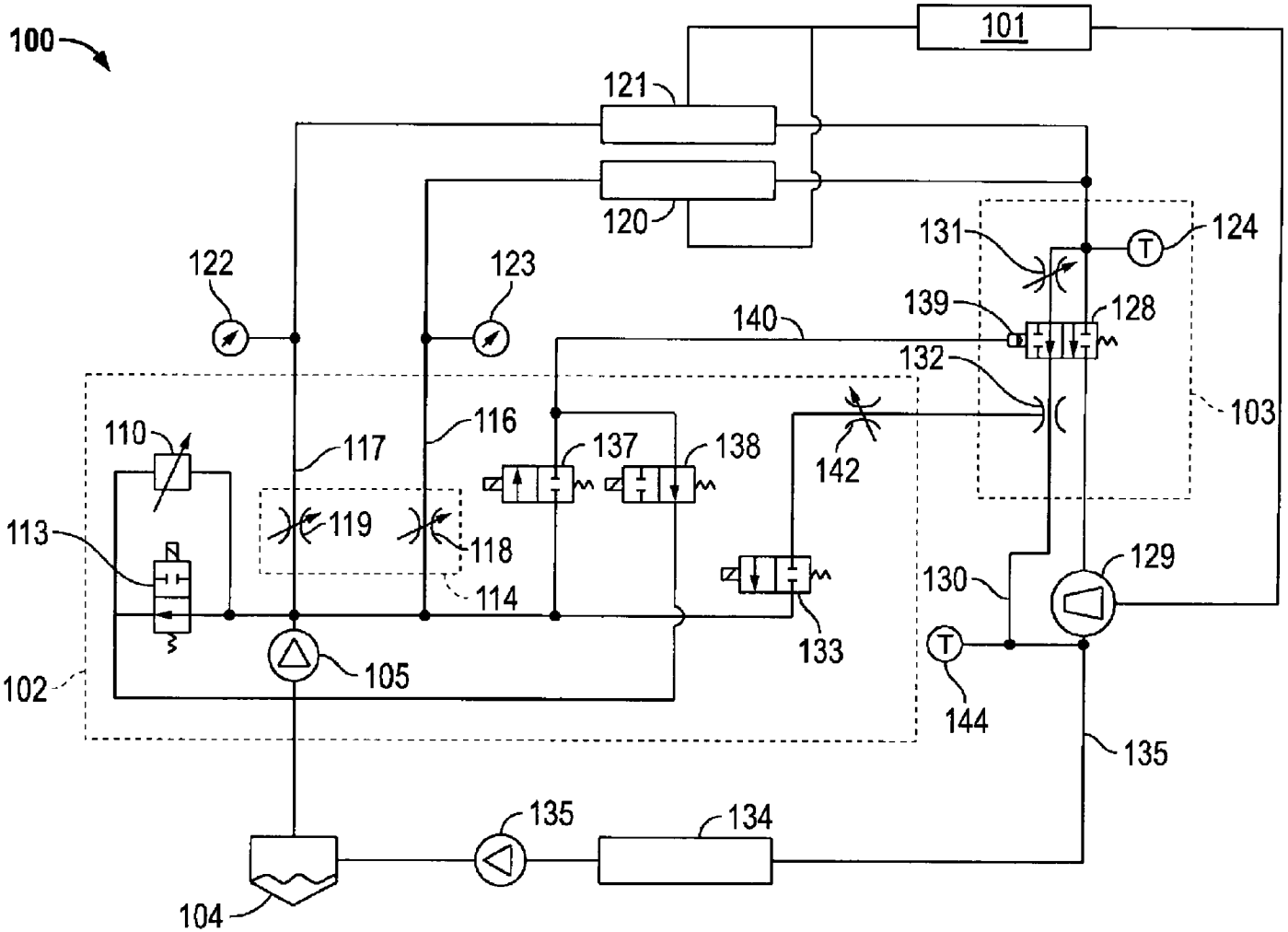
FIG. 1 shows a schematic of a waste heat recovery system 100 according to an embodiment.

FIG. 1 shows a schematic of a waste heat recovery system 100 for an engine 101 according to an embodiment. The waste heat recovery system 100 may be implemented for an engine 101 mounted on a motor vehicle (not shown) to drive that vehicle, for example. Therefore, the engine 101 may comprise an IC engine, in particular a reciprocating piston engine. The vehicle may be an on-road truck, the operation of which is set out in the standard 'highway cycle' or World Harmonised Test Cycle (WHTC). Such a truck engine may particularly be powered by diesel or natural gas. According to an embodiment, the waste heat recovery system 100 can include a fluid control module 102 and a vapor control module 103. According to an embodiment, the waste heat recovery system 100 includes a fluid supply 104. The fluid supply 104 may include a fluid, such as water, an organofluorine such as Freon®, or a hydrocarbon such as ethanol, or the like as the working fluid. The particular fluid used may vary from one application to another. For example, the fluid may be the fuel used by the engine 101. A high-pressure fluid pump 105 is in fluid communication with an outlet of the fluid supply 104. The high-pressure fluid pump 105 may be driven by the engine 101, e.g. from the engine crankshaft in the case of a reciprocating piston engine, or may be driven by a separate electric motor, for example. In some embodiments, the high-pressure fluid pump 105 may raise the pressure of the fluid to a threshold pressure of approximately 40 bar (580 psi) from the reservoir pressure, which is typically at atmospheric pressure. However, other threshold pressures are certainly possible and the particular example pressure should in no way limit the scope of the present embodiment.

A main system controller and electrical leads to the controllable components of the waste heat recovery system 100 are not shown in FIG. 1 to reduce the complexity of the figure. However, those skilled in the art will readily appreciate suitable electronics that may be used to control the waste heat recovery system 100. For example, the main system controller may comprise a portion of the vehicle's main electronics. The electronics can control the various valves that are described further below based on temperature and pressure measurements of the system, for example.

According to an embodiment, the fluid control module 102 can include a pressure control valve 110 and a system drain valve 113. In the embodiment shown, the system drain valve 113 comprises a normally open solenoid actuated valve. However, other types of valves can certainly be used. When de-actuated, the system drain valve 113 can drain the fluid back to the fluid supply 104. This may occur when the vehicle is turned off, when fluid is not desired to be run through the waste heat recovery system 100, or in the event of an emergency, for example. The fluid control module 102 may further comprise a valve module 114.

Those skilled in the art can readily recognize that while the high-pressure fluid pump 105 may deliver a varying pressure that is higher than the desired threshold pressure to the fluid control module 102, the pressure control valve 110 can ensure that the valve module 114 receives a relatively constant input pressure. According to an embodiment, the valve module 114 can include two or more fluid control valves 118, 119. In one embodiment, the two or more fluid control valves 118, 119 can be in the form of proportional valves. According to an embodiment, the valve module 114 can selectively provide a fluid communication path between the fluid supply 104 and one or more of the two or more evaporators 120, 121.

According to an embodiment, the two or more evaporators 120, 121 may receive waste heat generated by the engine 101. For example, in one embodiment, the first evaporator 120 uses the heat from the engine's EGR while the second evaporator 121 uses the heat from the engine's exhaust. A third evaporator, not shown, may receive heat from a third source, such as the charge air circuit. According to an embodiment, the two or more evaporators 120, 121 may be at different temperatures. Therefore, the valve module 114 can control the actuation of the valves 118, 119 based on a measured temperature at the inlet of the vapor control module 103, thereby selecting the proportion of the fluid flow from the pump that passes through the first evaporator and the proportion of the fluid flow from the pump that passes through the second evaporator. In addition to the temperature measured at the inlet of the vapor control module 103, pressure sensors 122, 123 may be provided at the outlets 116, 117 of the valve module 114. It should be appreciated however, that the pressure sensors 122, 123 are optional and may be omitted.

Because of the elevated temperature of the two or more evaporators 120, 121, the liquid leaving the valve module 114 can become a superheated vapor. For example, in one embodiment, the valve module 114 can control the two or more valves 118, 119 such that the superheated vapor entering the vapor control module 103 is at approximately 400° C. (752° F.) and 40 bar (580 psi). However, those skilled in the art can readily appreciate that these values may vary based on the particular application and should in no way limit the scope of the present embodiment.

As can be seen from FIG. 1, the vapor control module 103 can include a bypass valve 128. In the embodiment shown, the bypass valve 128 comprises a spring biased, fluid actuated 3/2-way valve. Alternatively, the bypass valve 128 may comprise a proportional flow control valve. In the embodiment shown, the bypass valve 128 can selectively provide a fluid communication path between the two or more evaporators 120, 121 and either an expander 129, which may be a piston expander, or a bypass circuit 130. According to an embodiment, the bypass valve 128 can be biased towards a first position where a fluid communication path is provided between the two or more evaporators 120, 121 and the bypass circuit 130. Therefore, in a default position, the expander 129 is bypassed and waste heat from the engine 101 is not recovered. Instead, the vapor flows directly to a condenser 134. According to an embodiment, in the first position, the fluid from the two or more evaporators 120, 121 flows through a needle valve 131 and a venturi 132. In some embodiments, the venturi 132 can receive an optional fluid supply from the fluid control module 102 via a de-superheat control valve 133. The de-superheat control valve 133 is in fluid communication with the pressurized fluid leaving the high-pressure fluid pump 105. Therefore, injection of cooling fluid into the bypass circuit 130 can cool the superheated vapor to de-superheat the fluid. De-superheating the fluid can provide a substantially cooler fluid to the condenser 134, which reduces the thermal shock to the condenser 134.

Additionally or alternatively, a flow control valve 142 may regulate the flow of the fluid from the de-superheat control valve 133 to the venturi 132. The flow control valve 142 may control the flow based on parameters in the waste heat recovery system 100 and/or the engine 101. For example, temperature gauges 124, 144 may provide a temperature of fluid flowing to the condenser 134. The flow control valve 142 may control the flow of the cooling fluid to the venturi 132 based on the temperature of the fluid flowing towards the condenser 134. The flow control valve 142 may also control the flow based on the engine's 101 power output. For example, the flow control valve 142 may increase the flow of cooling fluid to the vapor flowing to the condenser 134 when the engine's 101 power output drops due to the operator releasing the gas pedal. The cooling fluid may also de-superheat the vapor when the vapor control module 103 diverts the superheated fluid flow from the expander 129 to the condenser 134.

According to an embodiment, actuating a pilot supply valve 137 and an exhaust valve 138 can actuate the bypass valve 128 from the first position to a second position via a pilot valve actuator 139. The pilot supply valve 137 can supply fluid from the fluid supply 104 to a pilot valve actuator 139 via a fluid line 140. Therefore, the pilot supply valve 137 can selectively provide a fluid communication path between the fluid supply 104 and the pilot valve actuator 139. The fluid supplied to the pilot valve actuator 139 can actuate the bypass valve 128 to a second position. According to an embodiment, in the second position, the bypass valve 128 can selectively provide a fluid communication path between the two or more evaporators 120, 121 and the expander 129.

The superheated vapor flows to the expander 129 where it reduces in enthalpy while expanding as is generally known in the art. Therefore, the expander 129 can convert at least some of the energy of the superheated vapor to mechanical work. The expander 129 can comprise a variety of well-known devices, such as a turbine, a piston, a vapor engine, such as a rotary vane type vapor engine, etc. The particular type of expander 129 utilized is not important for purposes of the present description and should in no way limit the scope of the claims that follow. For purposes of the present application, the important aspect of the expander 129 is that it can convert the energy of the superheated vapor into useful mechanical energy. In some embodiments where the expander 129 comprises a vapor engine, for example, the expander 129 can be coupled to the crankshaft or other suitable component of the engine 101 in order to add power to the engine 101 as is generally known in the art. An example would be an overrunning clutch assembly, which can transfer power from the vapor engine to the engine 101, but not the reverse. According to an embodiment, the fluid can leave the expander 129 and travel to the condenser 134 via a fluid line 135 where the fluid is cooled and delivered back to the fluid supply 104.

With a basic description of the overall waste heat recovery system 100, attention is now drawn to the seals. The fluid control module 102 and the vapor control module 103 may have seals exposed to atmosphere that are only static seals. That is, there may not be any dynamic seals exposed to atmosphere or atmospheric dynamic seals. The term, 'atmospheric dynamic seals,' is not necessarily limited to dynamic seals with ambient air at atmospheric pressures on one side of the seal. For example, the atmospheric dynamic seals may refer to seals potentially exposed to pressures greater than and less than the standard earth atmosphere. Also, the term 'atmospheric' may include any ambient environment that surrounds the waste heat recovery system. Dynamic seals are seals that move relative to a sealing surface.

The waste heat recovery system 100 may employ fluid and vapor control modules that have no atmospheric dynamic seals. Instead, the dynamic seals may be exposed to, for example, the working fluid on both sides of the seal. For example, the vapor control module 103 may have a dynamic seal with superheated working fluid on one side and pressurized fluid on the other side. The pressurized fluid may be provided by the fluid control module 102 via the pilot supply valve 137. Accordingly, the waste heat recovery system 100 may have fluid and vapor control modules that do not employ atmospheric dynamic seals. Embodiments of the static seal fluid control modules are described in more detail in the following with reference to FIGS. 2-5.

Valve Module

Figure 2:
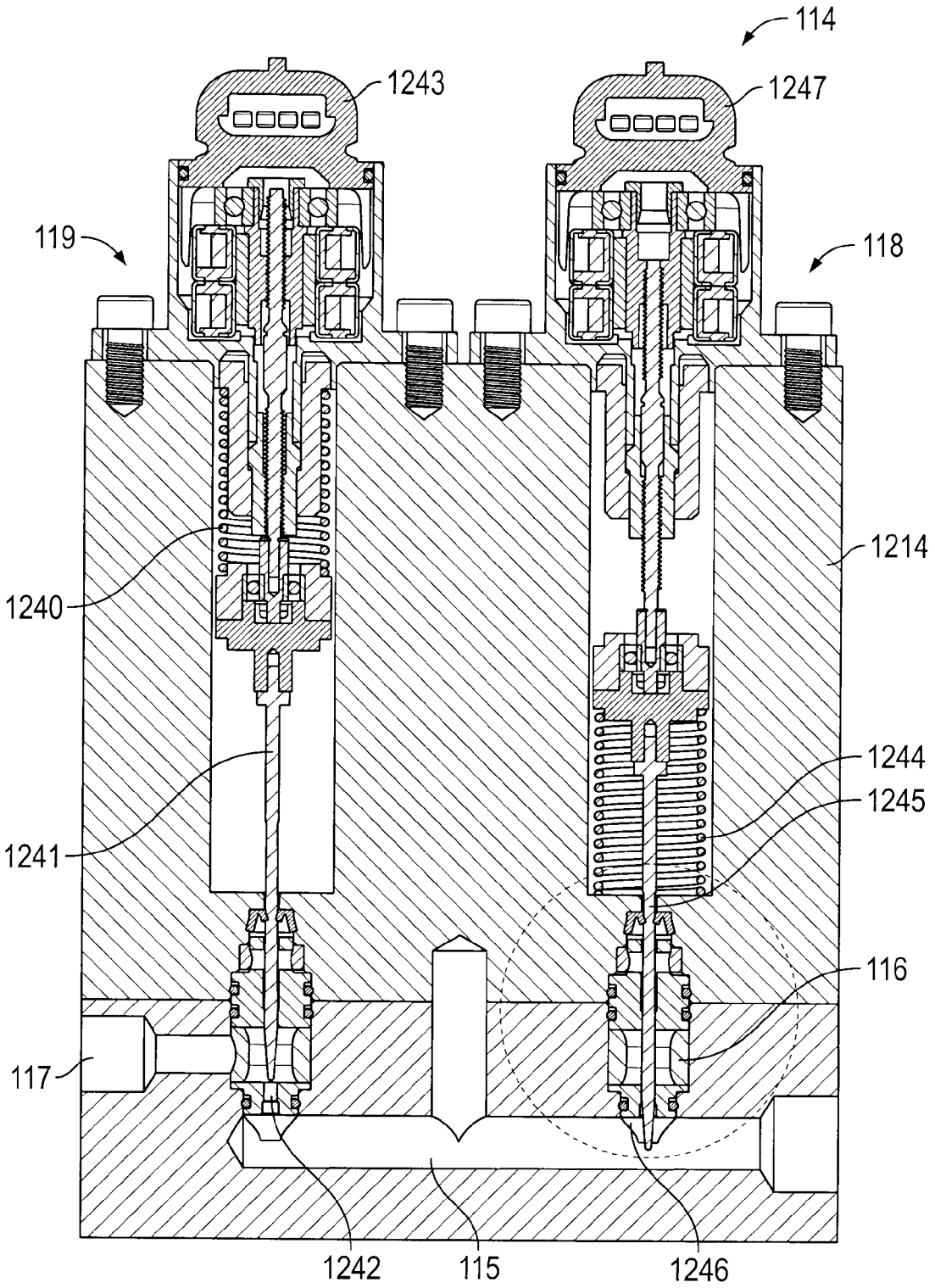
FIG. 2 shows a cross-sectional view of a valve module 114 according to an embodiment.

FIG. 2 shows a cross-sectional view of a valve module 114 according to an embodiment. According to an embodiment, the valve module 114 comprises a housing 1214, which may be separated into multiple parts as shown. According to the embodiment shown, the valve module 114 comprises the two liquid control valves 118, 119. According to an embodiment, the first liquid control valve 118 comprises a normally opened valve while the second liquid control valve 119 comprises a normally closed valve.

According to an embodiment, the first liquid control valve 118 comprises a biasing member 1244, which biases a valve member 1245 away from a valve seat 1246. In the embodiment shown, the valve member 1245 also comprises a needle. A linear stepper motor 1247 or some other actuator can be provided to actuate the valve member 1245 towards the valve seat 1246. According to an embodiment, the second liquid control valve 119 comprises a biasing member 1240, which biases a valve member 1241 towards a valve seat 1242. In the embodiment shown, the valve member 1241 comprises a movable needle. The needle is tapered, which allows for proportional control of the fluid. A linear stepper motor 1243 or some other actuator can be provided to actuate the valve member 1241 away from the valve seat 1242.

Although other types of actuators are certainly possible, linear stepper motors are generally known and can provide relatively accurate positional control, which can allow proportional fluid control. Therefore linear stepper motors are particularly suitable for the present application.

It should be appreciated that while the liquid control valves 118, 119 are described as comprising normally open and normally closed valves, the reverse could also occur. Alternatively, both of the valves 118, 119 may be biased towards the same direction, i.e., both normally closed or both normally open. Therefore, the particular configuration shown should in no way limit the scope of the present embodiment.

As shown in FIG. 2, the valve member 1241 can selectively provide a fluid communication path between the inlet 115 and the outlet 117. Similarly, the valve member 1245 can selectively provide a fluid communication path between the inlet 115 and the outlet 116.

Figure 3:
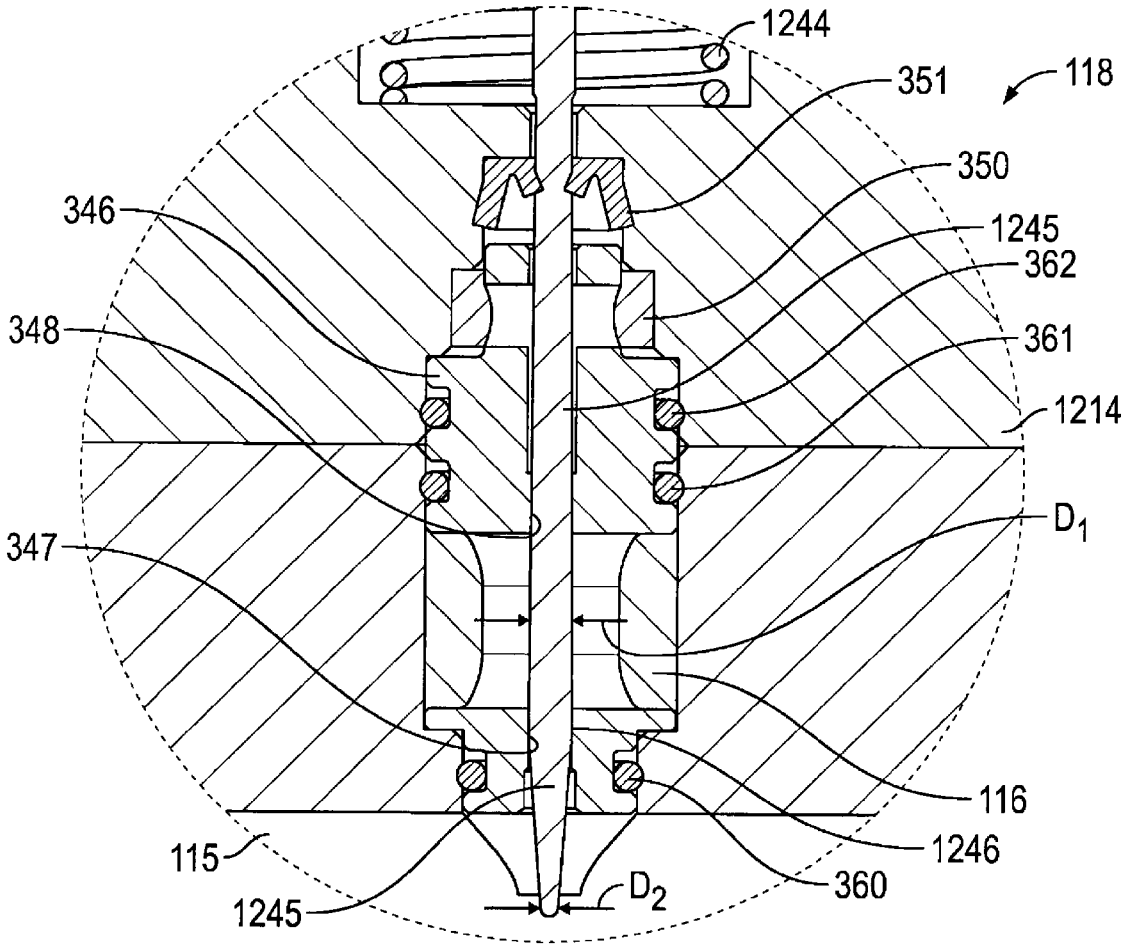
FIG. 3 is a detail view of FIG. 2.

FIG. 3 shows an enlarged view of a portion of the valve 118 of FIG. 2 according to an embodiment. Although the discussion relates to the valve 118, it should be appreciated that other than the position of the biasing members 1240, 1244, the valves operate substantially similarly. Therefore, the features discussed in relation to FIG. 3 can easily be applied for the valve 119. As mentioned above, the waste heat recovery system 100 can operate under relatively high pressures (40 bar, 580 psi) and elevated temperatures. Therefore, the valves 118, 119 include certain features that allow for such high pressures without failing prematurely. According to an embodiment, the valve seat 1246 can comprise one or more bushings 346, which forms a fluid tight seal with the valve module housing 1214. In the embodiment shown, a one-piece bushing 346 is provided; however, it should be appreciated that in alternative embodiments, the bushing 346 can be separated into multiple components. The bushing 346 can form a fluid tight seal with the housing 1214 via one or more sealing members 360, 361, 362. According to an embodiment, the bushing 346 can comprise a lower bore 347 and an upper bore 348. The valve member 1245 can slide within the lower and upper bores 347, 348 and can form a substantially fluid-tight seal. The seal between the valve member 1245 and the bores 347, 348 is due to the extremely tight tolerances between the components. Although the particular dimensions may vary, in one embodiment, the difference between the inner radius of the bores 347, 348 and the outer radius of the valve member 1245 is between 5-10 microns (0.0002-0.0004 inches). For example, in one embodiment, the valve member 1245 comprises a maximum diameter, $D_1$ of 2.0000 mm while the bores 347, 348 comprise an inner diameter of 2.0005 mm.

According to the embodiment shown, the valve member 1245 is in the closed position wherein a portion of the valve member 1245 having a maximum diameter, $D_1$ is sealed against the lower bore 347. Consequently, because of the tight sealing tolerance, a substantially fluid-tight seal is formed and most of the fluid is prevented from flowing from the inlet 115 towards the outlet 116. However, as the valve member 1245 is raised upwards (according to the orientation shown), the diameter of the valve member 1245 proximate the lower bore 347 decreases to a minimum diameter, $D_2$. As the diameter proximate the lower bore 347 decreases, a space between the valve member 1245 and the lower bore 347 is created to allow fluid to flow from the inlet 115 towards the outlet 116. As can be appreciated, when the entire valve member 1245 is above the lower bore 347, a maximum flow can be achieved. However, while at least a portion of the valve member 1245 remains within a portion of the lower bore 347, proportional flow control can be achieved.

Although the tight tolerances between the bores 347, 348 and the valve member 1245 are designed to provide a substantially fluid tight sealing, at higher pressures, some fluid is likely to leak past the substantially fluid-tight seal and thus, the valve module 114 includes a fluid return port 350. The fluid return port 350 is positioned between the bushing 346 and the biasing member 1244. The fluid return port 350 may be in fluid communication with the fluid supply 104, for example. While the maximum diameter $D_1$ of the valve member 1245 maintains a substantially fluid tight seal with the upper bore 348, in the event that fluid flows past the valve member/upper bore interface, the fluid will simply be diverted back to the fluid supply 104 at a substantially reduced pressure via the fluid return port 350. A sealing member 351 can also prevent fluid from flowing past the fluid return port 350 towards the biasing member 1244. According to an embodiment, the sealing member 351 may comprise an elastomer sealing member with a lip that engages the valve member 245, the substantially reduced pressure in port 350 reducing friction and wear of the seal. However, other types of sealing members may be used.

Figure 4:
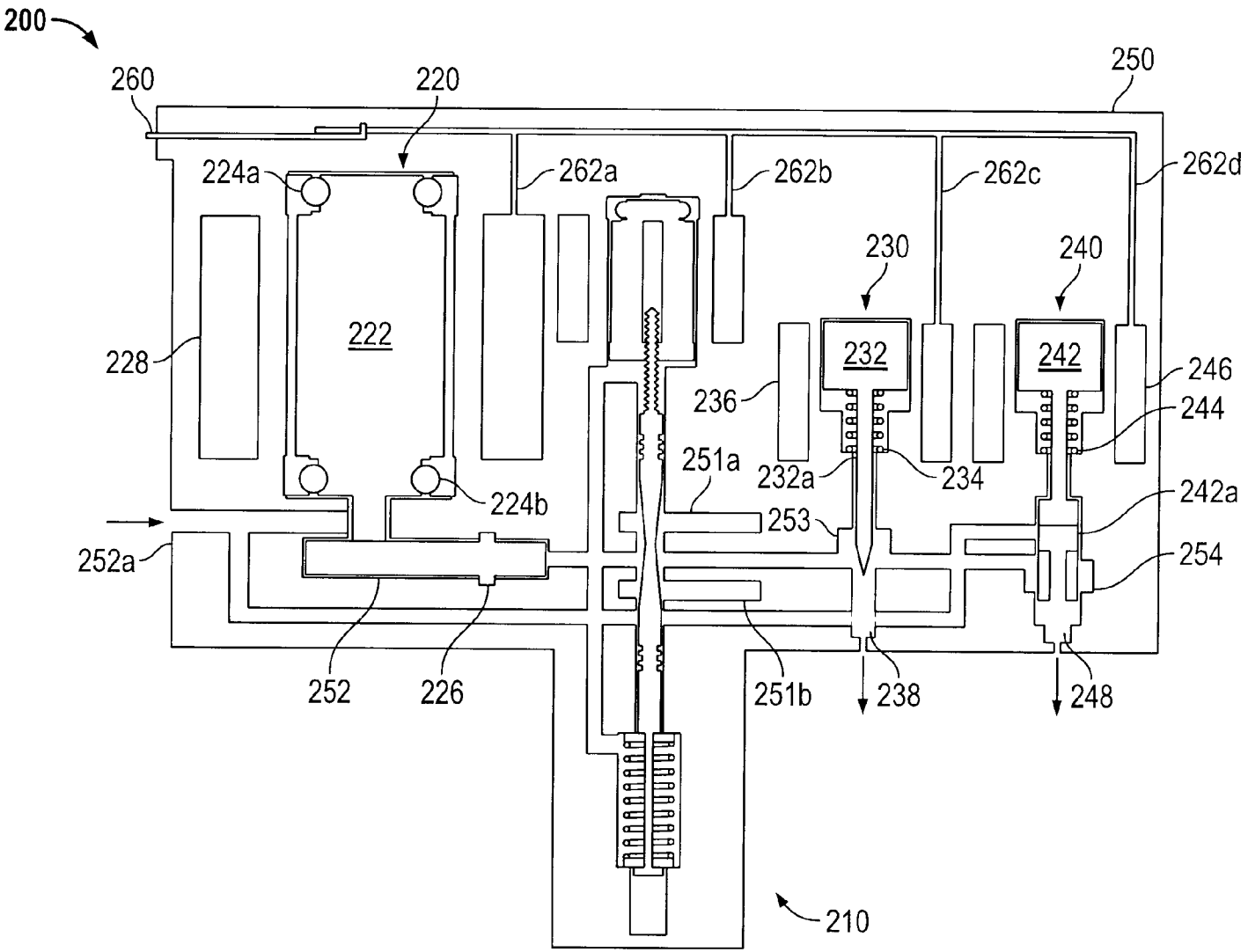
FIG. 4 shows a first fluid control module 200 according to an embodiment.

The features described above for the valve module 114 allow for precise and proportional control of high-pressure liquids First Static Seal Fluid Control Module FIG. 4 shows a first static seal fluid control module 200 according to an embodiment. The first static seal fluid control module 200 may correspond to the fluid control module 102 shown in FIG. 1. The first static fluid control module 200 may not have any atmospheric dynamic seals. As shown, the first static seal fluid control module 200 may include a proportional flow control valve 210, an electrically-powered pump 220, a de-superheat control valve 230, and a bypass control valve 240 enclosed by a module body 250. The module body 250 may include a power line 260 that is coupled to conductors 262*a-d*. The power line 260 and the conductors 262*a-d* may provide electrical power to the proportional flow control valve 210, the pump 220, the de-superheat control valve 230, and the bypass control valve 240 so the first static seal fluid control module 200 may regulate the flow of the working fluid in the waste heat recovery system 100. The module body 250 may be comprised of stainless steel selected for corrosion and heat resistant properties although any suitable material may be employed. Magnetic properties may also be considered. The proportional flow control valve 210 may be adapted to proportionally regulate the working fluid between the evaporators 120, 121. The proportional flow control valve 210 is described in more detail in the following with reference to FIG. 5.

Still referring to FIG. 4, the pump 220 may include a pump rotor 222 that is movably (e.g., rotatably) coupled to the module body 250 via rotor bearings 224*a,b*. The pump rotor 222 may be comprised of a ferromagnetic material. The pump rotor 222 may also be coupled to an impeller 226 that is in an impeller chamber 252. The pump rotor 222 may be magnetically coupled to a pump stator 228. The pump stator 228 may be coupled to the power line 260 via the conductor 262*a*. The pump rotor 222, the rotor bearings 224*a,b*, and the impeller 226 may be comprised of material that is selected for magnetic properties as well as compatibility with the working fluid. The pump stator 228 may be enclosed by the module body 250. The pump stator 228 may be comprised of a conductor such as copper configured to generate a magnetic field with current supplied by the power line 260.

The de-superheat control valve 230 may include a valve core 232 that is slidably coupled to the module body 250. A return spring 234 may be disposed between the valve core 232 and the module body 250 to provide a biasing force. As shown, the biasing force presses the valve core 232 to place the de-superheat control valve 230 in an open or zero position state. The valve core 232 may be magnetically coupled to a solenoid 236. The valve core 232 may include a stem 232*a* that is partially disposed in a de-superheat control chamber 253. The solenoid 236 may be coupled to the power line 260 via the conductor 262*c*. The de-superheat control chamber 253 may be in fluid communication with a de-superheat port 238.

The bypass control valve 240 may include a valve core 242 that is slidably coupled to the module body 250. The valve core 242 may be comprised of a ferromagnetic material selected for material compatibility with the working fluid. A return spring 244 may be disposed between the valve core 232 and the module body 250 to provide a biasing force. As shown, the biasing force presses the valve core 242 to place the bypass control valve 240 in an open or zero position state as shown. A solenoid 246 may be magnetically coupled to the valve core 242. The return spring 244 may also be disposed in a bypass control chamber 254. The bypass control chamber 254 may be in fluid communication with a bypass pilot port 248. The valve core 242 may include a stem 242*a* that is adapted to regulate the working fluid flow through the bypass pilot port 248.

As shown in FIG. 4, the module body 250 may include chambers are that in fluid communication with each other. For example, the impeller chamber 252 may be in fluid communication with the de-superheat control chamber 253 and the bypass control chamber 254. The module body 250 may also include inlets and outlets that are in fluid communication with other parts of the waste heat recovery system 100. For example, evaporator ports 251*a,b* may be in fluid communication with the evaporators 120, 121. In addition to being in fluid communication with the bypass pilot port 248, the bypass control chamber 254 may be in fluid communication with the de-superheat port 238 and the impeller chamber 252. An inlet 252*a* may be in fluid communication with the impeller chamber 252 and may provide working fluid to the proportional flow control valve 210. Exemplary flows through the module body 250 are shown by arrows at the inlet 252*a* and the ports 238, 248.

In an embodiment, the module body 250 may enclose the proportional flow control valve 210, the pump 220, the de-superheat control valve 230, and the bypass control valve 240. Components in the module body 250 may be immersed in the working fluid. For example, the pump rotor 222, the valve core 232, and the valve core 242 may be immersed in the working fluid. There may also be no atmospheric dynamic seals between, for example, the pump rotor 222 or the valve cores 232, 242 and the module body 250. Accordingly, the working fluid may be retained by the module body 250 and static seals at the evaporator ports 251*a,b*, the de-superheat port 238, and the bypass pilot port 248. Although retained by static seals, the working fluid flow through the first static seal fluid control module 200 may be regulated, for example, by the proportional flow control valve 210, which is described in more detail in the following.

Figure 5:
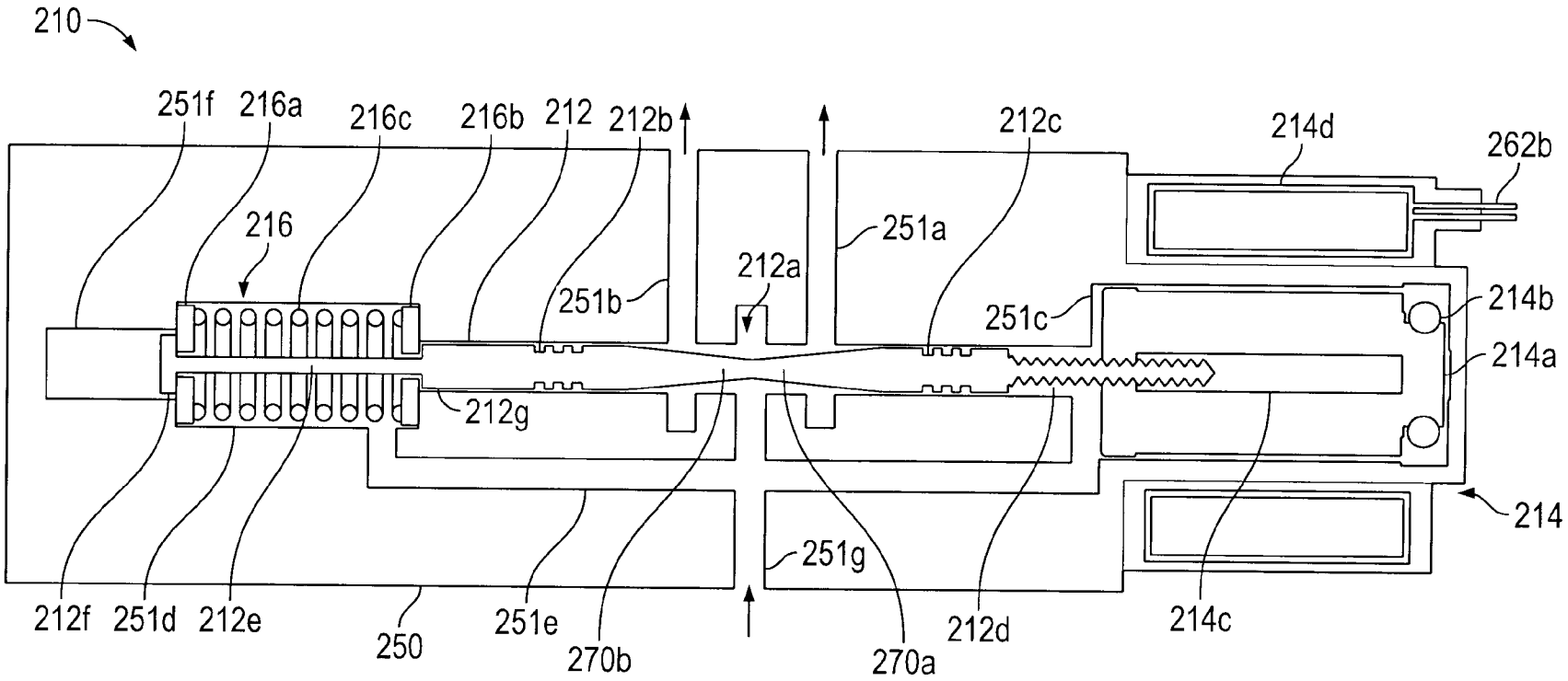
FIG. 5 shows an enlarged view of the proportional flow control valve 210 shown in FIG. 4.

FIG. 5 shows an enlarged view of the proportional flow control valve 210 shown in FIG. 4. The proportional flow control valve 210 may include a proportional stem 212 that is coupled to a motor 214. The proportional stem 212 may also be coupled to a return spring assembly 216. The proportional stem 212 may be slidably coupled to the module body 250. A portion of the proportional stem 212 and the motor 214 may be disposed in a motor chamber 251*c*. A portion of the proportional stem 212 and the return spring assembly 216 may be disposed in a spring chamber 251*d*. The motor chamber 251*c* and the spring chamber 251*d* may be fluidly coupled with each other via a conduit 251*e*. A portion of the proportional stem 212 may also be disposed in a displacement chamber 251*f*.

The proportional stem 212 may include a flow control profile 212*a* that may proportionally regulate the flow of the working fluid through the first evaporator port 251*a* and the second evaporator port 251*b*. The flow profile can be adapted to have a constant flow capacity that is independent of the position of the valve stem and may be viewed as comprising first and second valve members 270*a*, 270*b* adapted to regulate a flow of the working fluid between the inlet port and the first evaporator port 251*a* and the second evaporator port 251*b* respectively, the first and second valve members being arranged symmetrically on the stem.

Inner stem bushings 212*b,c* on the proportional stem 212 may guide the movement of the proportional stem 212. The proportional stem 212 may also include stem threads 212*d* slidably coupled to the motor 214. The stem threads 212*d* may be adapted to move the proportional stem 212 in a linear direction in the module body 250 as the rotor 214*a* rotates. An assembly rod 212*e*, a stem bushing 212*f*, and a shoulder 212*g* on the proportional stem 212 may press against portions of the return spring assembly 216 as will be discussed in more detail in the following.

The motor 214 may include a rotor 214*a* that is movably (e.g., rotatably) coupled to the module body 250 via a bearing 214*b*. A stator 214*d* may be magnetically coupled to the rotor 214*a*. The rotor 214*a* may be coupled to the proportional stem 212 via a rotor hub 214*c*. The stator 214*d* may be electrically coupled to the conductor 262*b*. The stator 214*d* may be adapted to use electrical power provided by the conductor 262*b* to rotate the rotor 214*a* via the magnetic coupling.

The return spring assembly 216 may include an outer spring retainer 216*a*, an inner spring retainer 216*b*, and a return spring 216*c*. The return spring 216*c* may press the outer spring retainer 216*a* and the inner spring retainer 216*b* against an inner surface of the spring chamber 251*d* and the stem bushing 212*f* and the shoulder 212*g*. As shown in FIG. 5, the return spring 216*c* is pressing the outer and inner spring retainers 216*a, b* against the inner surface of the spring chamber 251*d*. The proportional stem 212 is shown in a zero position. In the zero position, the working fluid flow ratio between the first evaporator port 251*a* and the second evaporator port 251*b* may be about 1. That is, the working fluid flow rate through the first evaporator port 251*a* and the second evaporator port 251*b* may be the same. Alternately, the zero or default position may be configured to provide any flow ratio needed to satisfy the application. For example: alternate default flow ratios can be achieved by simply moving the relative position of the profile 212*a* of the stem 212 in relation to the zero or default position of return spring assembly 216.

In operation, the proportional stem 212 may move linearly in the module body 250. The stator 214*d* may use electrical power to rotate the rotor 214*a* which moves the proportional stem 212 via the stem threads 212*d*. As the proportional stem 212 moves linearly in the module body 250, a flow rate ratio of the working fluid through the first evaporator port 251*a* and the second evaporator port 251*b* changes due to the flow control profile 212*a*. For example, when the proportional stem 212 is displaced towards the displacement chamber 251*f*, the working fluid flow rate through the second evaporator port 251*b* is greater than the working fluid flow rate through the first evaporator port 251*a*. The ratio may be proportional to the amount the proportional stem 212 is displaced from the zero position.

When the conductor 262*d* does not have power, the return spring assembly 216 may move the proportional stem 212 to the zero position. For example, if the proportional stem 212 is fully displaced towards the displacement chamber 251*f* by the motor 214, the return spring 216*c* may press the proportional stem 212 towards the motor 214 when the motor 214 loses power. The proportional stem 212 may therefore move to the zero or default position shown in FIG. 5.

The displacement dimensions of the spring chamber 251*d* and the rotor hub 214*c* may be selected to prevent the proportional stem 212 from blocking the fluid flow through the proportional flow control valve 210. For example, a length of the displacement chamber 251*f* may be sufficient to allow the proportional stem 212 to fully compress the return spring 216*c* and limit flow through the first evaporator port 251*a* and allow fluid to flow from an inlet 251*g* to the second evaporator port 251*b*. An exemplary fluid flow is shown by arrows at the ports 251*a,b,g*. Other dimensions may be selected to prevent proportional stem 212 from blocking the working fluid flow through the proportional flow control valve. For example, the stem threads 212*d* may be dimensioned to reach the bottom of the rotor hub 214*c* to prevent the proportional stem 212 from moving further towards the motor 214. Additionally or alternatively, a shoulder on the proportional stem 212 may also reach the rotor 214*a*, thereby preventing the proportional stem 212 from further moving towards the motor 214.

Accordingly, when the first static seal fluid control module 200 loses power, proportional stem 212 may return to the zero position where the working fluid may flow through the proportional flow control valve 210 at its predetermined default ratio. The working fluid may therefore always flow through the proportional flow control valve 210. The proportional flow control valve 210 may be fail-safe in that the working fluid is not prevented from flowing through the waste heat recovery system 100 by the proportional flow control valve 210. As a result, pressure may not build up in, for example, the evaporators 120, 121 to cause a rupture in the waste heat recovery system 100.

In the event of a catastrophic failure in the proportional flow control valve 210, the working fluid may continue to flow through the proportional flow control valve 210. For example, if the return spring 216*c* were to break or seize in the spring chamber 251*d*, the proportional stem 212 may not be pressed towards the zero position. However, due to, for example, the displacement dimensions of the spring chamber 251*d* and the rotor hub 214*c* not allowing the proportional stem 212 to block the fluid flow. In such a failure mode, the working fluid may still flow through the proportional flow control valve 210 thereby preventing an undesirably high pressure in the waste heat recovery system 100. Other embodiments that provide the same benefits may be provided as will be described in the following with reference to FIGS. 4 and 5.

Second Static Seal Fluid Control Module

Figure 6:
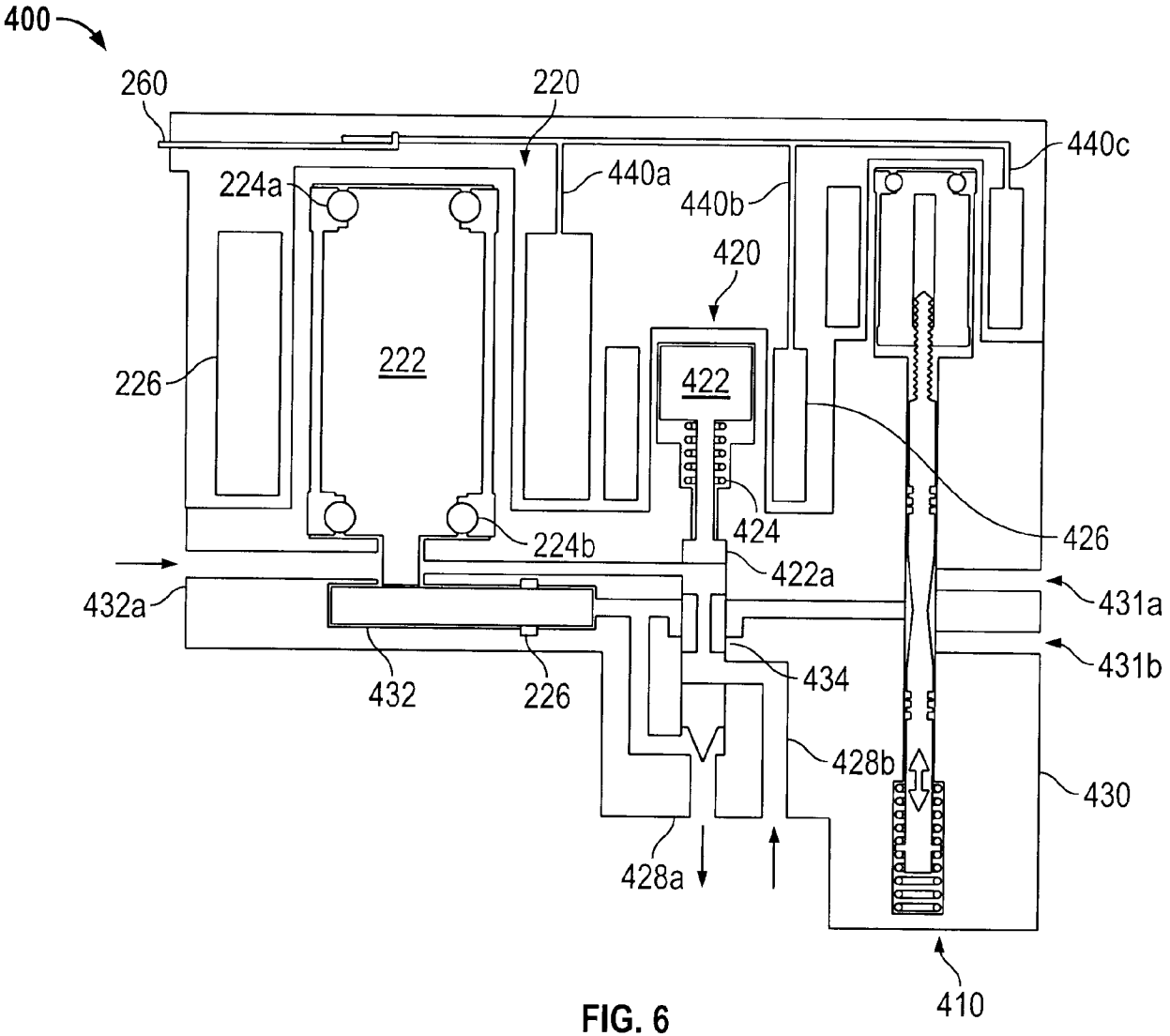
FIG. 6 shows a second fluid control module 400 according to an embodiment.

FIG. 6 shows a second static seal fluid control module 400 according to an embodiment. The second static seal fluid control module 400 is similar to the first static seal fluid control module 200. The second static seal fluid control module 400 includes a proportional flow control valve 410 and an integrated control valve 420 in a module body 430. The second static seal fluid control module 400 also includes the pump 220 described in the foregoing with reference to FIG. 4. Similar to the module body 250, the module body 430 may be comprised of stainless steel. The proportional flow control valve 410 is similar to the proportional flow control valve 210 as will be explained in more detail in the following with reference to FIG. 7. The second static seal fluid control module 400 may also include conductors 440*a-c* that are coupled to the power line 260. The conductors 440*a-c* may also be coupled to the pump 220, the proportional flow control valve 410, and the integrated control valve 420.

The integrated control valve 420 may be functionally similar to the de-superheat control valve 230 and the bypass control valve 240. That is, the integrated control valve 420 may combine the functions of the de-superheat control valve 230 and the bypass control valve 240. The integrated control valve 420 may include a valve core 422 that is slidably disposed in the module body 430. The integrated control valve 420 may also be coupled to the module body 430 via a return spring 424 that presses the valve core 422 to a released position. The released position is shown in FIG. 6.

The valve core 422 may be disposed in an integrated chamber 434. The valve core 422 may include an integrated stem 422*a* the both regulates fluid flow to the bypass valve 128 and to the venturi 132. The integrated control valve 420 may also include a stator 426 that is magnetically coupled to the valve core 422.

The module body 430 may include chambers that are in fluid communication with each other. For example, an impeller chamber 432 may be in fluid communication with the integrated chamber 434 via the conduits shown in FIG. 6. The module body 430 may also include inlets and outlets that are in fluid communication with each other. As shown, an inlet 432*a* may be in fluid communication with a de-superheat port 428*a* and a bypass pilot port 428*b* via the integrated chamber 434. The inlet 432*a* may also be in selective and proportional fluid communication with a evaporator ports 431*a,b*. An exemplary fluid flow through the module body 430 is shown by the arrows at the inlet 432*a* and the ports 428*a,b*. Similar to the first fluid control module 200, components in the module body 430 may be immersed in the working fluid. The proportional flow control valve 410 may proportionally regulate the working fluid flow through the second static seal fluid control module 400 to the evaporator ports 431*a,b* as will be described in the following.

Simplified Schematic of a Static Seal Fluid Control Module

Figure 7:
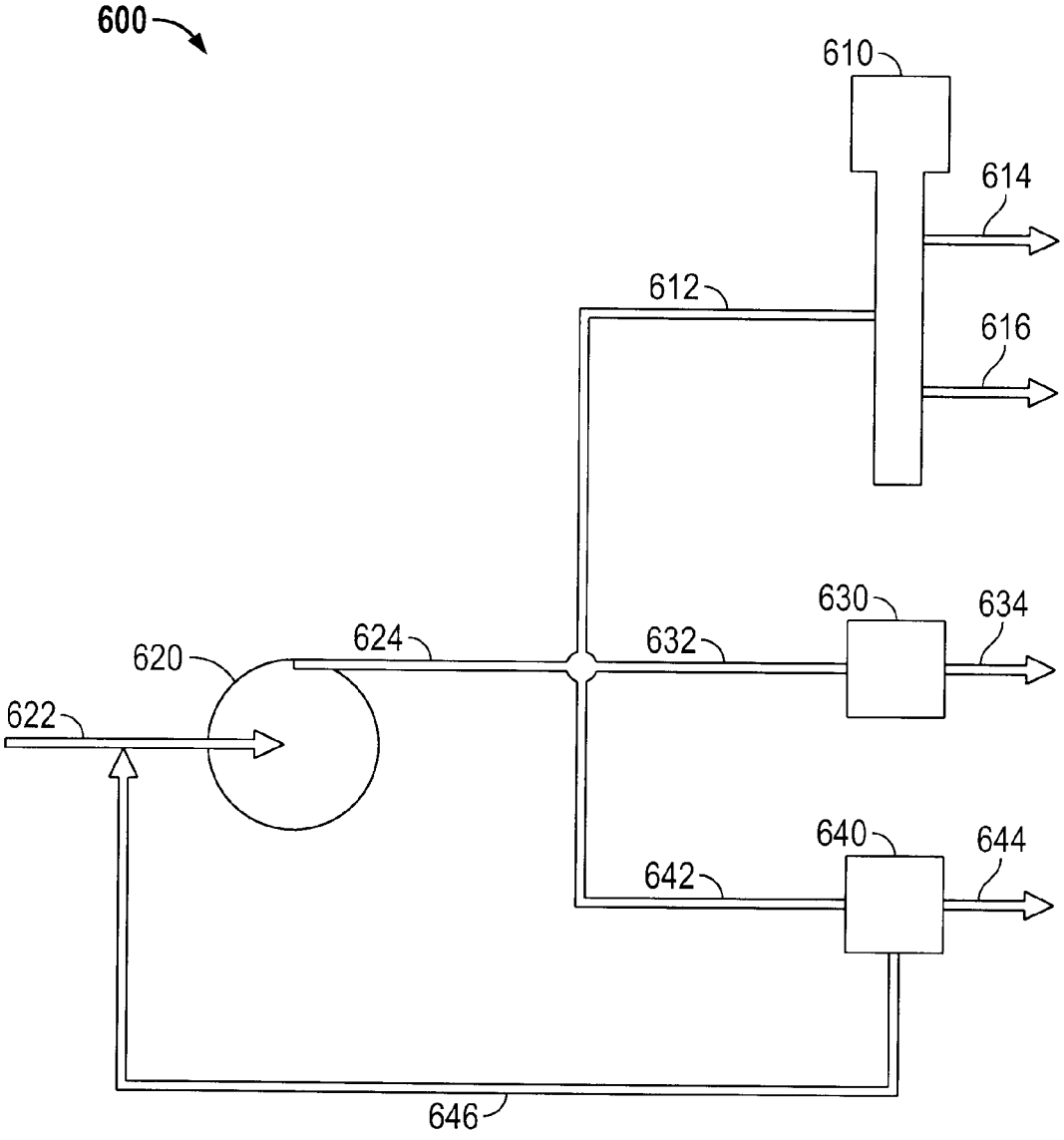
FIG. 7 shows a simplified schematic of a fluid control module schematic 600 according to an embodiment.

FIG. 7 shows a simplified schematic of a fluid control module schematic 600 according to an embodiment. The fluid control module schematic 600 may be a schematic representation of the first static seal fluid control module 200 or second static seal fluid control module 400. The fluid control module schematic 600 includes a proportional flow control valve 610 that may be in fluid communication with a pump 620. The fluid control module schematic 600 may also include a de-superheat control valve 630 and a bypass control valve 640 that may also be in fluid communication with the pump 620.

The proportional flow control valve 610 may be a simplified representation of the proportional flow control valve 210 and the proportional flow control valve 410 described in the foregoing. The proportional flow control valve 610 may proportionally regulate the flow from the pump 620 to the evaporator outlets 614, 616. The first evaporator outlet 614 may be in fluid communication with, for example, the first evaporator 120. Similarly, the second evaporator outlet 616 may be in fluid communication with the second evaporator 121.

The pump 620 may be a simplified representation of the pump 220 described with reference to FIGS. 4 and 6. The pump 620 may receive fluid from the inlet 622. The inlet 622 may correspond with the inlet 252*a* and the inlet 432*a*. The pump 620 may receive working fluid from the inlet 622 and supply it to the proportional control valve 610, the de-superheat control valve 630 and the bypass control valve 640 via a valve inlet 612, a de-superheat inlet 632, and a bypass control inlet 642, respectively.

The de-superheat control valve 630 and the bypass control valve 640 may regulate the flow of the working fluid to the de-superheat port 634 and the bypass pilot port 644, respectively. For example, the de-superheat control valve 630 may proportionally regulate the flow of the working fluid to the bypass circuit 130 via the venturi 132. The bypass control valve 640 may selectively regulate the flow of the working fluid to the pilot valve actuator 139 on the bypass valve 128. The bypass control valve 640 may also regulate the flow of the working fluid to the pump 220 via the pump return 646.

The foregoing describes the bypass valve 128 as being actuated by the working fluid. Accordingly, the waste heat recovery systems 100 and 600 may not have atmospheric dynamic seals. However, fluids other than the working fluid may be used to actuator a bypass valve without an atmospheric dynamic seal as will be described in the following.

Figure 8:
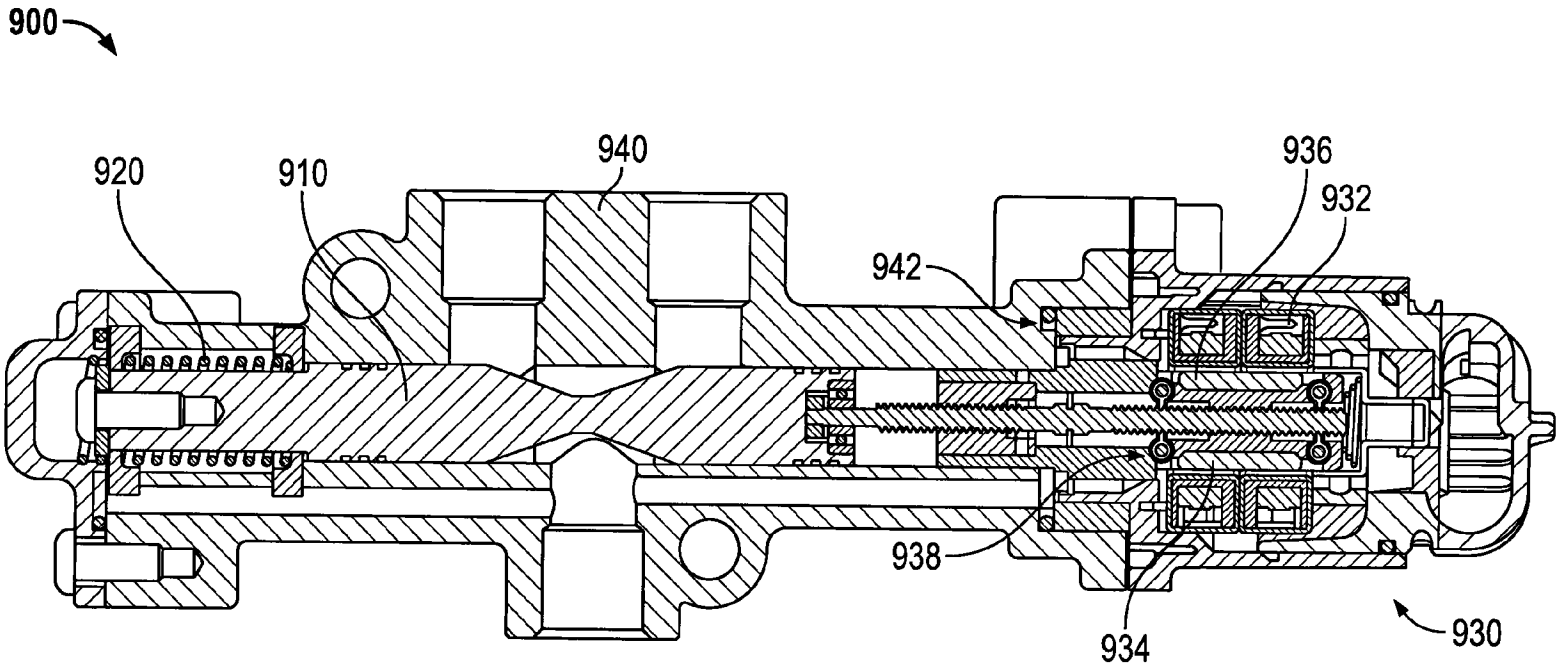
FIG. 8 shows another embodiment of a flow splitter.

FIG. 8 shows another embodiment of a flow splitter 900. The spool 910 is coupled to a return spring 920 similar to an earlier embodiment. The spool is actuated with a brushless linear electric drive motor 930. This motor has a dry stator 932 and a wet rotor 934 that are separated by a sealed can 936 that seals against the module body 940 as indicated at 942. In this way, the can 936 serves as a membrane that contains the working fluid so as to eliminate leakage of working fluid to atmosphere.

As indicated at 938, rotor 934 drives a double helix and ball bearings to provide smooth travel of the spool and to allow the centralizing spring 920 to back drive the motor in reverse. The construction is all stainless steel with low friction, high wear coatings on the spool. The unit is capable of engine mounting and has an IP69 automotive connector. The unit has porting to allow approximately a 9 mm diameter flow path. The profile of the spool can further be varied to accommodate specific distribution requirements. Any appropriate means of moving the spool may be employed.

Figure 9A:
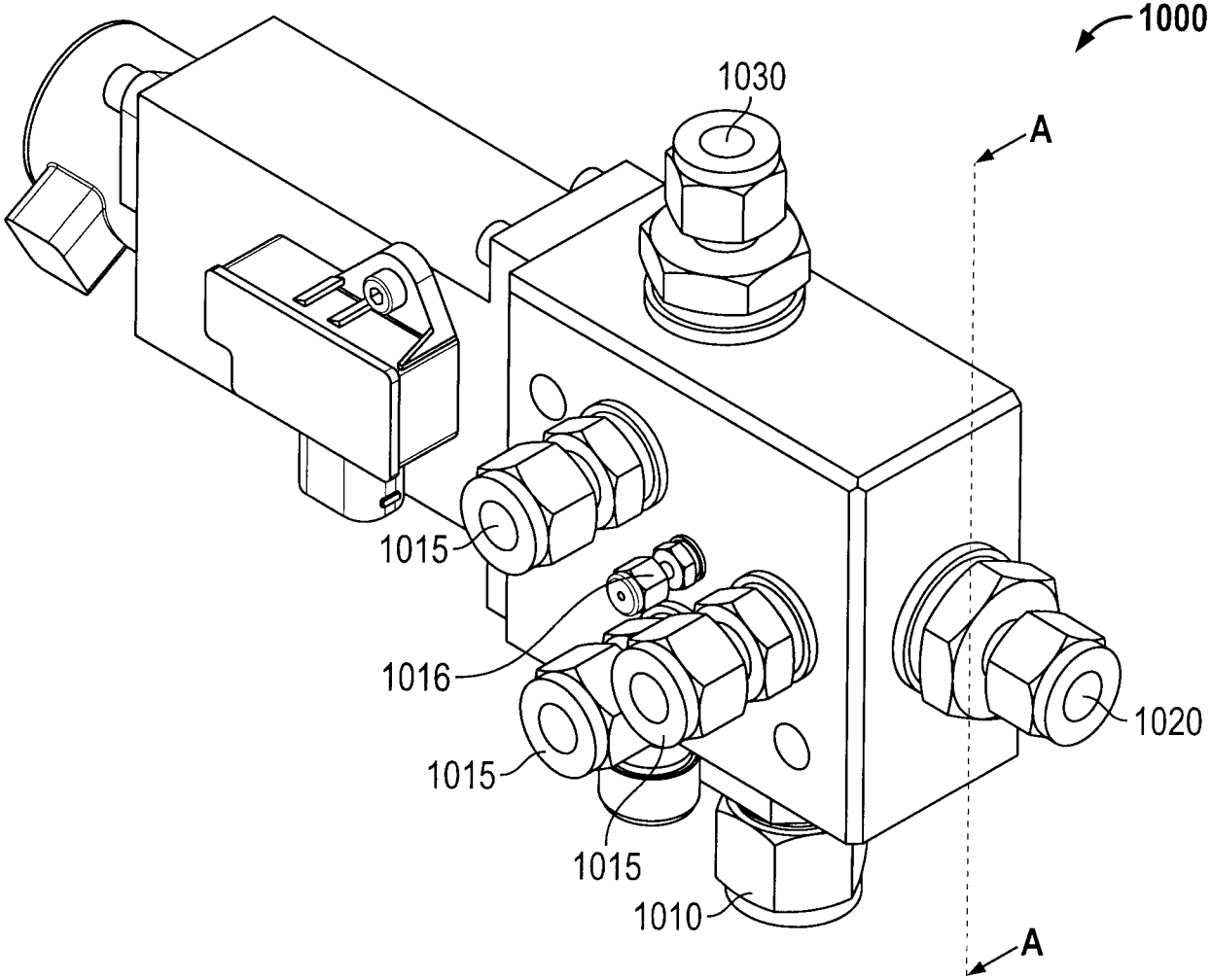
FIGS. 9A and B are perspective and cross-sectional views of a further embodiment of a flow splitter.
Figure 9B:
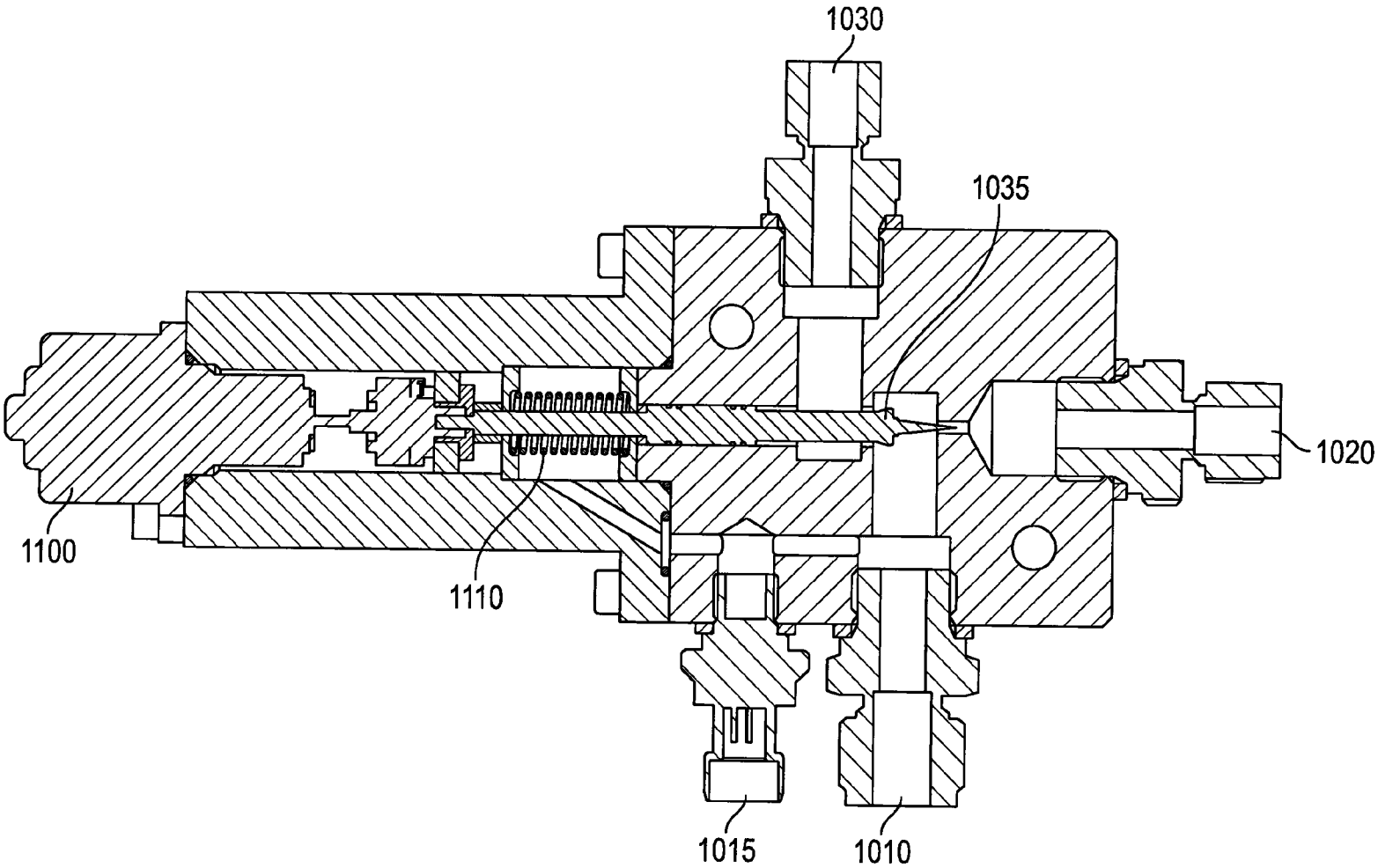
FIG. 9C is a detail view of FIG. 9B.
FIG. 9D is a detail view of FIG. 9C.

FIG. 9A is a perspective view of another embodiment of a flow splitter 1000, the cross-sectional view along AA being shown in FIG. 9B. Splitter 1000 has a fluid inlet 1010, a first fluid outlet 1020 to a first evaporator (not shown) located in the exhaust gas recirculation system and a second fluid outlet 1030 to a second evaporator (not shown) located in the exhaust gas flow to the tailpipe. Sensors 1015 allow the measurement of differential fluid pressures and the fluid pressure at the fluid inlet, while sensor 1016 measures temperature.

Stem 1035 is configured to allow a greater maximum flow rate from inlet 1010 to second fluid outlet 1030 than from inlet 1010 to first fluid outlet 1020. This may be appropriate in situations where heat recovery from the exhaust gas flow to the tailpipe is always going to be greater than the heat recovery from the exhaust gas recirculation flow.

Figure 9C:
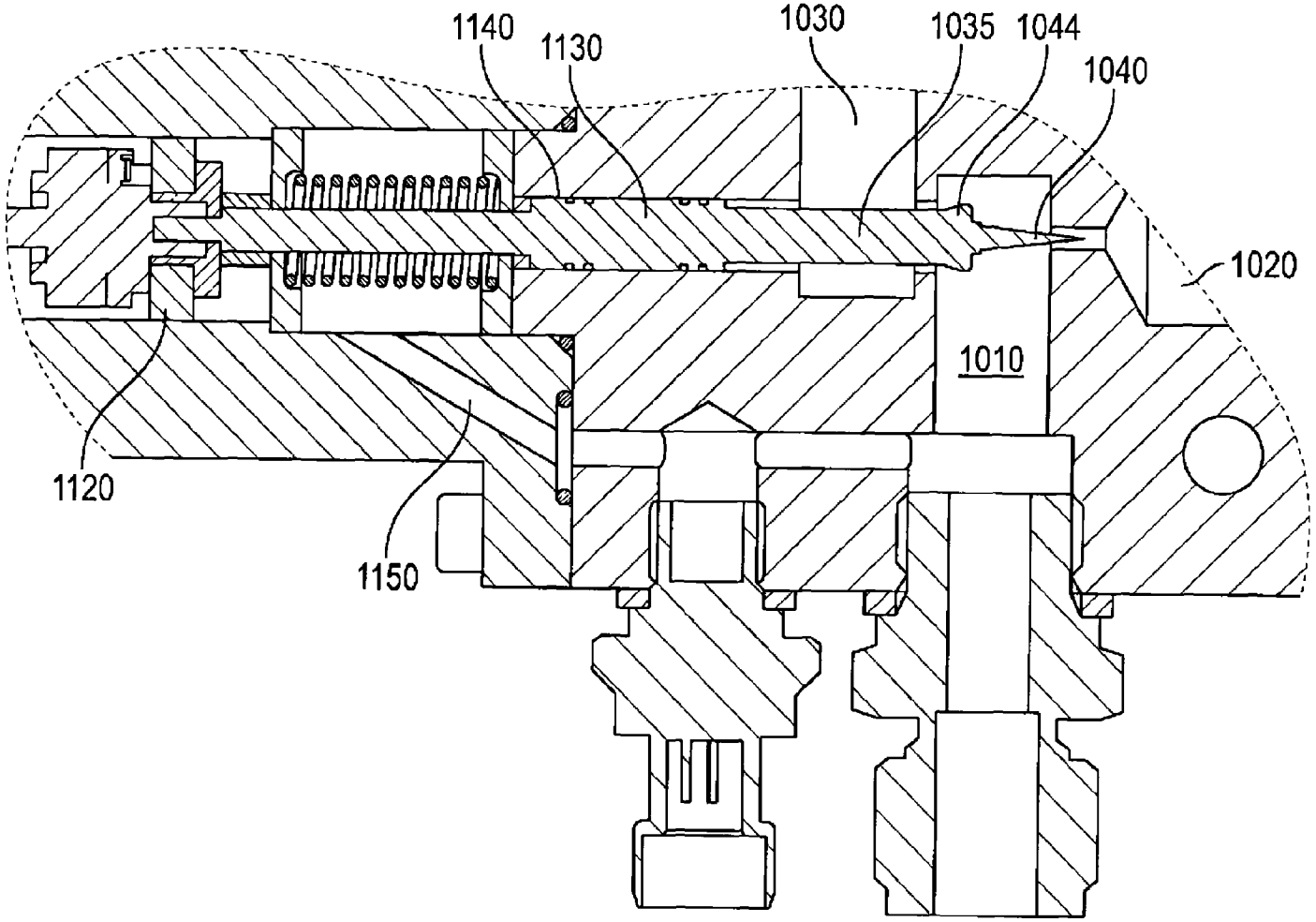
Figure 9D:
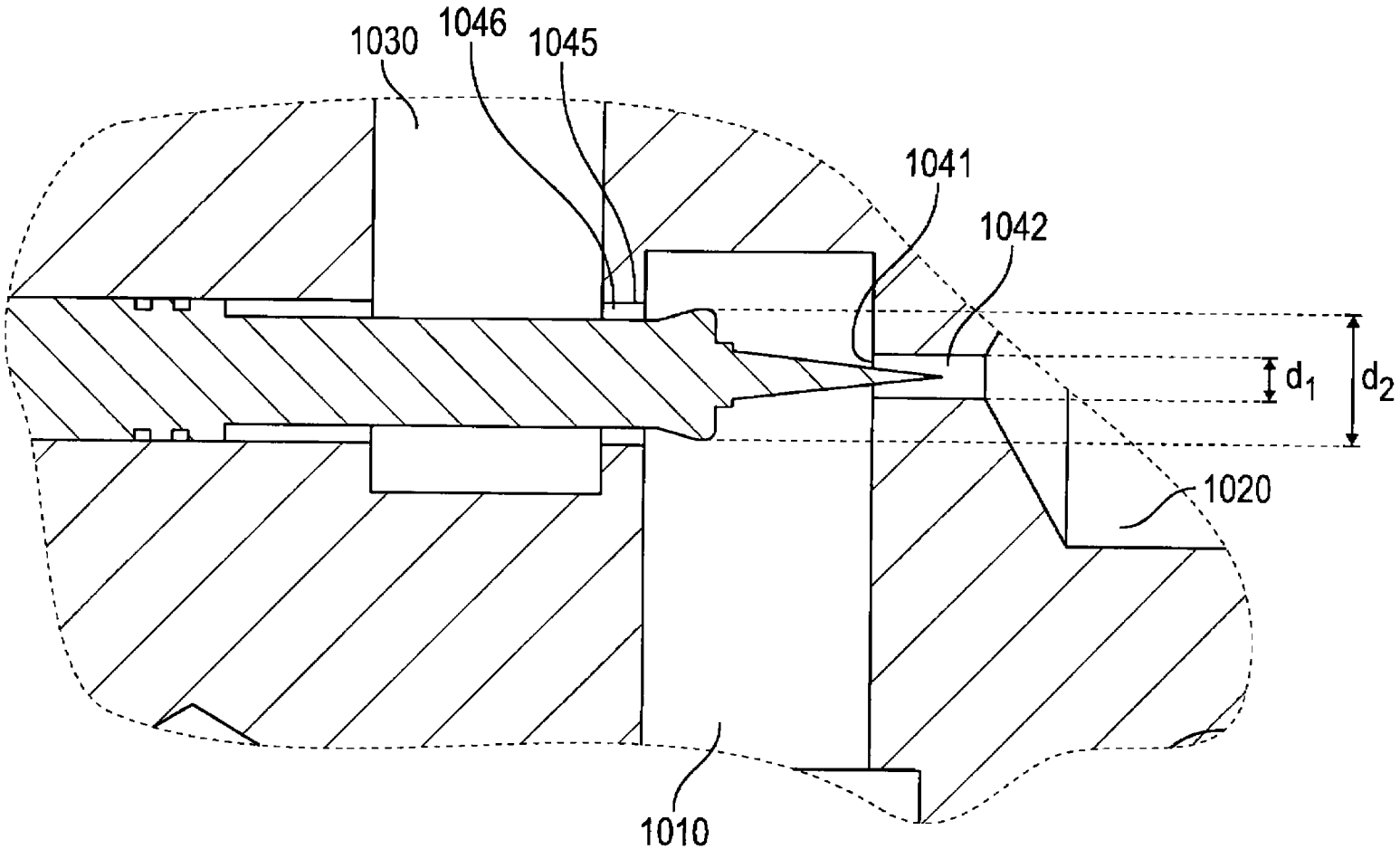

Referring to FIGS. 9C and 9D, stem 1035 comprises, at one end, a first tapered needle 1040 that moves in and out of a first seat 1041 at one end of a first bore 1042 of diameter dl between inlet 1010 and first fluid outlet 1020. Spaced along the stem from the first needle is a second tapered, frusto-conical valve member 1044 that moves relative to a second seat 1045 at one end of a second bore 1046 of diameter d2 between the inlet 1010 and the second fluid outlet 1030. It will be appreciated that this second valve assembly is akin to that employed in the embodiments of FIGS. 5,7 and 9. The relative dimensions of the first and second valve assemblies comprising respective valve members, seats and bores are chosen such that the maximum flow rate from inlet 1010 to second fluid outlet 1030 is greater than the maximum flow rate from inlet 1010 to first fluid outlet 1020. In the particular embodiment shown in FIG. 9D, d2 is greater than d1, with the maximum flow rate through d1 typically being around 20% of the flow rate through d2.

In other words, in a flow control valve having two or more distribution legs, one leg is being modulated over a relatively small flow range while the other is modulated over a much larger flow range, combining the low flow modulating characteristics of a small, tapered needle valve while also having the large flow characteristic of a larger bore spool valve.

As in previous embodiments, axial displacement of the stem results in one needle valve assembly opening and the other closing, the stem being displaced axially by an actuator 1100 against a spring 1110 configured to return the stem to a zero or default position, the position of the stem being sensed by a sensor comprising a magnet 1120 attached with the actuator and spring to the opposite end of the stem to the valve assemblies, the stem being supported between its ends by a spool portion 1130 slideable in a housing bore 1140. Given the assymetric construction outlined above, the other end of the stem communicates with the fluid inlet by way of a passageway or balancing gallery 1150 so as to balance the pressure forces acting on the stem.

Benefits of the Static Seal Fluid Control Modules

As described in the foregoing, the static seal fluid control modules 200, 400 may selectively and proportionally regulate the working fluid flow through the waste heat recovery system 100 without atmospheric dynamic seals. For example, the static seal fluid control modules 200, 400 may proportionally regulate the working fluid flow to the evaporators 120, 121. The static seal fluid control modules 200, 400 may also selectively regulate the working fluid flow to other parts of the waste heat recovery system 100. For example, the static seal fluid control modules 200, 400 may actuate the bypass valve 128 with fluid flow regulated by the bypass control valve 240 or the integrated control valve 420. In this example, the bypass control valve 240 or the integrated control valve 420 may selectively supply the working fluid to the pilot valve actuator 139 to actuate the bypass valve 128. The supply of the working fluid to the pilot valve actuator 139 may also be proportionally regulated by the static seal fluid control modules 200, 400. That is, the bypass valve 128 may be a proportional bypass valve that proportionally regulates the flow between the bypass circuit 130 and the expander 129.

The static seal fluid control modules 200, 400 may be in fluid communication with the vapor control module 103 via the fluid line 140. Accordingly, there may be working fluid on both sides of a dynamic seal in, for example, the bypass valve 128. That is, the bypass valve 128 may employ a dynamic seal. However, it may not be an atmospheric dynamic seal because working fluid is employed on both sides of the dynamic seal in the bypass valve 128. Additionally or alternatively, a membrane bypass valve may be actuated with no atmospheric dynamic seals using fluids other than the working fluid, such as pressurized air.

The embodiments described above provide a static seal fluid control module 200, 400 and a waste heat recovery system 100 that can draw heat from two or more evaporators 120, 121. Accordingly, since no atmospheric dynamic seals are employed, the working fluid may not leak to atmosphere via dynamic seals. Combustible working fluid may therefore be employed in close proximity with the engine 101 without contacting hot portions of the engine. For example, the working fluid may not leak onto the engine exhaust and thereby preventing undesired combustion of the working fluid. The static seal fluid control modules 200, 400 may also continue to flow working fluid through the waste heat recovery system 100 when power is not provided to the static seal fluid control modules 200, 400. Accordingly, the working fluid may not become over pressurized thereby avoiding catastrophic failure of the module bodies 250, 430.

The detailed descriptions of the above embodiments are not exhaustive descriptions of all embodiments contemplated by the inventors to be within the scope of the present description. Indeed, persons skilled in the art will recognize that certain elements of the above-described embodiments may variously be combined or eliminated to create further embodiments, and such further embodiments fall within the scope and teachings of the present description. It will also be apparent to those of ordinary skill in the art that the above-described embodiments may be combined in whole or in part to create additional embodiments within the scope and teachings of the present description.

Thus, although specific embodiments are described herein for illustrative purposes, various equivalent modifications are possible within the scope of the present description, as those skilled in the relevant art will recognize. The teachings provided herein can be applied to other waste heat recovery systems, and not just to the embodiments described above and shown in the accompanying figures. Accordingly, the scope of the embodiments described above should be determined from the following claims.

We claim:

1. A waste heat recovery system (100) for an engine (101), comprising:

a fluid supply (104);

two or more evaporators (120, 121) adapted to receive waste heat from an engine (101);

a valve module (114) including an inlet port (115) in fluid communication with the fluid supply (104), a first outlet port (116) in fluid communication with a first evaporator (120) of the two or more evaporators (120, 121), and a second outlet port (117) in fluid communication with a second evaporator (121) of the two or more evaporators (120, 121), the module being adapted to selectively provide a fluid communication path between the fluid supply (104) and one or more of the two or more evaporators (120, 121); and wherein the first and second liquid control valves comprise at least one of a proportional needle valve member and a proportional stem that is adapted to proportionally regulate a flow of the working fluid between the first outlet port and the second outlet port.

2. The waste heat recovery system of claim 1 and comprising an expander (129) in fluid communication with an outlet of the two or more evaporators (120, 121).

3. The waste heat recovery system of claim 1 and comprising a condenser (134) in fluid communication with an outlet of the expander (129) and an inlet of the fluid supply (104).

4. The waste heat recovery system (100) of claim 1, wherein the valve module (114) comprises a first liquid control valve (118) selectively providing a fluid communication path between the fluid supply (104) and the first evaporator (120) and a second liquid control valve (119) selectively providing a fluid communication path between the fluid supply (104) and the second evaporator (121).

5. The waste heat recovery system (100) of claim 1, further comprising one or more bushings (346) positioned within a housing (214) of the valve module (114) and forming a substantially fluid-tight seal with a needle valve member (241,245).

6. The waste heat recovery system (100) of claim 5, wherein the needle valve member (245) comprises a tapered needle having a maximum diameter (D1), which tapers down to a minimum diameter (D2).

7. The waste heat recovery system (100) of claim 5 or claim 6, further comprising an elastomer sealing member (351) forming a substantially fluid-tight seal between the needle valve member (245) and the housing (214) outside of the substantially fluid-tight seal between the valve member (245) and the one or more bushings (346).

8. The waste heat recovery system (100) of claim 7, further comprising a communication path between the fluid supply (104) and the elastomer sealing member (351).

9. The waste heat recovery system of claim 1, wherein the proportional stem is adapted to have a constant flow capacity that is independent of the position of the valve stem.

10. The waste heat recovery system of claim 9, wherein the stem comprises first and second valve members adapted to regulate a flow of the working fluid between the inlet port and the first outlet port and the second outlet port respectively, the first and second valve members being arranged symmetrically on the stem.

11. The waste heat recovery system of claim 1, wherein the stem is adapted to allow a maximum flow rate between the inlet port and the second outlet port that is greater than the maximum flow rate between the inlet port and the first outlet port.

12. The waste heat recovery system of claim 11, wherein the stem comprises first and second valve members adapted to regulate a flow of the working fluid between the inlet port and the first outlet port and the second outlet port respectively, the first and second valve members being arranged asymmetrically on the stem.

13. The waste heat recovery system of claim 12, wherein the stem comprises a first tapered needle valve member engageable with a first valve seat and a second tapered frusto-conical valve member enagageable with a second valve seat.

14. The waste heat recovery system of claim 12, wherein the stem is pressure balanced with respect to the fluid pressure in the inlet port.

15. The waste heat recovery system (100) of claim 1, wherein the valve module comprises a return spring assembly (216, 416) adapted to return the proportional stem, 412) to a zero position state.

16. The waste heat recovery system of claim 1, further comprising a linear motor having a moving element adapted to displace the proportional stem and a stator, the moving element and stator being separated by a static seal.

17. The waste heat recovery system of claim 16, wherein the valve module comprises a housing in which moves the proportional stem, the static seal engaging the housing.

18. The waste heat recovery system of claim 17, wherein the moving element is a rotor and the static seal is a can adapted to surround the rotor.

19. The waste heat recovery system of claim 1, further comprising a linear motor having a stator, a rotor and a reversible lead screw adapted to be driven by the rotor.

20. The waste heat recovery system (100) of claim 1, further comprising a pressure control valve (110) in parallel with the valve module (114).

21. The waste heat recovery system (100) of claim 1, further comprising a pump (105; 220) adapted to pump fluid from the fluid supply (104) to the inlet port (115) of the valve module (114).

22. The waste heat recovery system (100) of claim 21, wherein the pump is adapted to be driven electrically.

23. The waste heat recovery system (100) of claim 22, wherein the pump is adapted to be directly driven by the engine.

24. A method for recovering waste heat from an engine, comprising:

providing two or more evaporators to receive waste heat from the engine;

selectively providing a fluid from a fluid supply to the two or more evaporators;

wherein the step of selectively providing the fluid from the fluid supply to the two or more evaporators comprises proportionally controlling a fluid communication path between the fluid supply and a first one of the two or more evaporators with a first liquid control valve and proportionally controlling a fluid communication path between the fluid supply and a second one of the two or more evaporators with a second liquid control valve; and wherein the proportional control uses at least one of a needle shaped valve member that forms a substantially fluid-tight seal with one or more bushings and a proportional valve stem that is adapted to proportionally regulate a flow of the working fluid between the first outlet port and the second outlet port.

25. The method of claim 24, comprising outputting the fluid from one or more of the two or more evaporators to an expander, which converts at least a portion of the energy of the fluid into mechanical energy.

26. The method of claim 24, comprising outputting the fluid from the expander to a condenser in fluid communication with the fluid supply.

27. The method of claim 24, wherein the valve module comprises a return spring assembly (216, 416) adapted to return the proportional valve stem, 412) to a zero position state.

28. The method of claim 24, further comprising a step of actuating a pressure control valve to control a pressure of the fluid provided to the two or more evaporators.

* * * * *